US008933643B2

(12) United States Patent
Ascorra et al.

(10) Patent No.: US 8,933,643 B2
(45) Date of Patent: Jan. 13, 2015

(54) DISPLAY BACKLIGHT DRIVER IC CONFIGURATION

(71) Applicant: Apple Inc., Cupertino, CA (US)

(72) Inventors: Alejandro Lara Ascorra, Gilbert, AZ (US); Shimon Elkayam, San Jose, CA (US); Asif Hussain, San Jose, CA (US); Brad Lee Patton, Campbell, CA (US); Steven J. Sfarzo, Los Gatos, CA (US); Eric G. Smith, San Jose, CA (US)

( * ) Notice: Subject to any disclaimer, the term of this patent is extended or adjusted under 35 U.S.C. 154(b) by 196 days.

(21) Appl. No.: 13/659,888

(22) Filed: Oct. 24, 2012

(65) Prior Publication Data

US 2013/0278171 A1 Oct. 24, 2013

Related U.S. Application Data

(60) Provisional application No. 61/636,590, filed on Apr. 20, 2012.

(51) Int. Cl.
*H05B 37/02* (2006.01)

(52) U.S. Cl.
USPC ..... 315/291; 315/297; 315/302; 315/307

(58) Field of Classification Search
USPC ..... 315/291, 294, 297, 302, 307
See application file for complete search history.

(56) References Cited

U.S. PATENT DOCUMENTS

| | | | | |
|---|---|---|---|---|
| 5,454,114 | A * | 9/1995 | Yach et al. | 713/330 |
| 7,366,891 | B2 | 4/2008 | Khanna et al. | |
| 7,535,254 | B1 | 5/2009 | Case | |
| 7,990,081 | B2 | 8/2011 | Chandran et al. | |
| 2009/0026981 | A1 * | 1/2009 | Li Volsi | 315/302 |
| 2010/0128064 | A1 * | 5/2010 | Taylor et al. | 345/690 |
| 2010/0194308 | A1 * | 8/2010 | Zhao et al. | 315/297 |
| 2011/0089847 | A1 * | 4/2011 | Qin | 315/246 |
| 2011/0304597 | A1 | 12/2011 | Hyatt | |

* cited by examiner

*Primary Examiner* — Jason M Crawford
(74) *Attorney, Agent, or Firm* — Womble Carlyle Sandridge & Rice, LLP

(57) ABSTRACT

One embodiment of a display backlight driver integrated circuit can be configured for operation in at least two different ways. A first method transfers data from an EEPROM to hardware registers prior to regular operation. A second method also transfers data from an EEPROM to registers. However, hardware registers can be overwritten with data accepted from a control bus, prior to regular operation. A keyboard driver IC can detect the presence or absence of a cable to an LED. If the cable is absent, the driver IC will not supply power for the LED. One embodiment of a keyboard and display backlight control system can be configured to allow substantially independent operation.

20 Claims, 11 Drawing Sheets

DISPLAY BACKLIGHT DRIVER IC CONFIGURATION

CROSS REFERENCE TO RELATED APPLICATIONS

This U.S. patent application claims priority under 35 USC 119(e) to U.S. Provisional Patent Application No. 61/636,590 filed Apr. 20, 2012 entitled "Display Backlight Driver IC" by Ascorra et al. which is incorporated by reference in its entirety for all purposes.

FIELD OF THE DESCRIBED EMBODIMENTS

The described embodiments relate generally to light emitting diode (LED) controllers, and more particularly configurable LED controllers capable of controller two independent LED systems.

BACKGROUND

Portable computing devices often include displays to provide a user graphical or textual information. The displays often include a backlight that enables the display to be used in low or dim ambient lighting environments. There can be some displays that are not useable without at least some amount of backlight. In some embodiments, portable computing devices can also include a backlight for an included keyboard.

Display and keyboard backlights typically require controllers to control dimming of the respective lights and also to provide a voltage for powering the LED (light emitting diode) arrays that typically provide the backlights. Portable computing devices are continually getting smaller and thinner. As a consequence, LED controllers must also become smaller and more integrated.

Some integrated LED controller solutions lack configuration flexibility. That is, while some LED controllers can work well in a first mode of operation, the same LED controller may not work as well in a second mode of operation, especially when an operating mode can be based on an operating system. Examples of operating systems are Windows® from Microsoft®, Mac-OS® from Apple Inc.®, Linux, UNIX and others. For example, a portable computing device including a particular LED controller can boot with no difficulty with a first operating system; however, the same LED controller can exhibit artifacts such a flashing and blinking when booting with a second operating system.

Therefore, what is desired is a relatively compact configurable LED controller that can easily be configured to operate in multiple operating modes.

SUMMARY OF THE DESCRIBED EMBODIMENTS

This paper describes various embodiments that relate to a configurable LED control system. In one embodiment a method for configuring an LED controller for use in a computing device can include the steps for detecting a power on reset event, prior to enabling LED operation, copying data from a memory located within a LED controller to hardware control registers, replacing data in the control registers with additional data and then enabling LED operation.

In another embodiment, a configurable LED controller for use in a computing device can include a power on reset detector, a non-volatile memory, one or more hardware registers for controlling LED operation and a control signal input configured to write data into the one or more registers before enabling LED operation.

In yet another embodiment, a system controller for an backlight for a computing device can include a LED array configured to backlight a display, a LED controller including: a power on reset detector, a non-volatile memory including data for a first operational mode, hardware registers configured to control the LED array and a control signal interface configured to over write data in hardware registers and a timing controller configured to provide a pulse width modulated signal.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION OF SELECTED EMBODIMENTS

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

A compact and configurable LED controller system can comprise a boost converter and a LED driver integrated circuit (IC). Together, the boost converter and the LED driver IC can control a keyboard backlight LED array and a display backlight LED array and allow independent control of each LED array. The configurable LED controller system can be configured to work in a plurality of operational modes. In one embodiment, the operational modes can be modes related to different operating systems.

Figure 1:
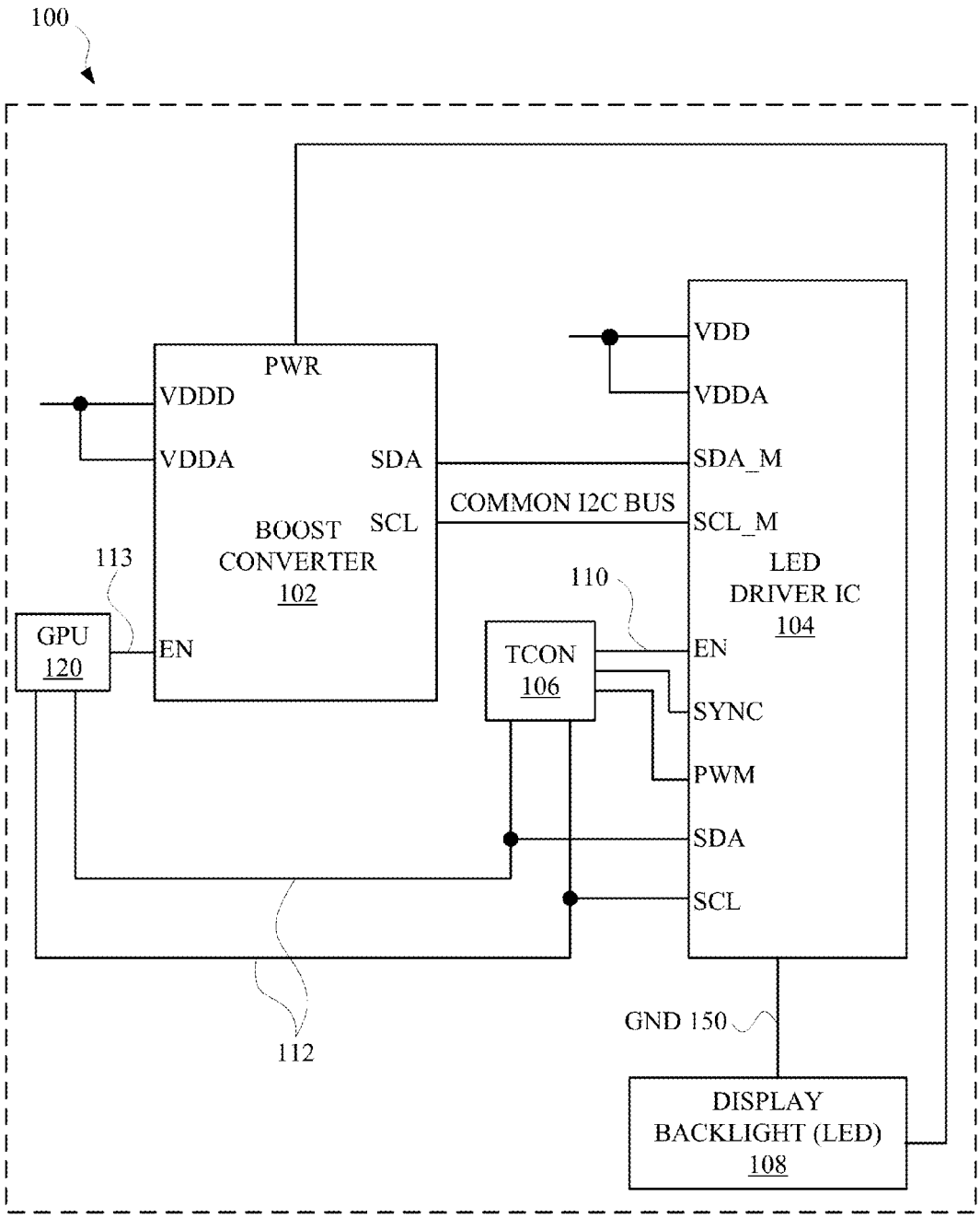
FIG. 1 is a block diagram of an LED driver integrated circuit (IC) in a system, in accordance with one embodiment of the specification.

FIG. 1 is a block diagram of an LED driver integrated circuit (IC) in a system 100, in accordance with one embodiment described in the specification. The system 100 can include LED driver IC 104, that can be configured to control a display LED 108 by sinking current from the display LED 108. In one embodiment, system 100 can be included in a computing device such as a portable computer, a media player, a personal digital assistant or the like. The display LED can receive power from a boost converter 102. The boost converter 102 can receive input voltages (VDDD, VDDA and Vbat) and, in one embodiment, up convert an input voltage from a first, lower voltage to a second higher (boost) voltage. In this Figure, the boost voltage can be provided to display LED 108. The system can include a timing controller (TCON) 106 that can be configured to provide at least one pulse width modulated (PWM) signal to LED driver IC 104. In one embodiment, the PWM signal can be used to control, at least in part, the current being directed to ground 150 from the display LED 108.

System 100 can also include graphics processing unit (GPU) 120. In one embodiment, GPU 120 can provide control signals 112 to TCON 106 and LED driver IC 104. One example of control signals can be a serial control bus that can include at least two signals: clock and data. For example, a serial clock (SCL), and a serial data (SDA) signal can be sent from GPU 120. In other embodiments, GPU 120 can be replaced with any other suitable device for generating and monitoring control signals such as a micro-controller, processor, state machine, field programmable gate array (FPGA), processor or the like. The LED driver IC 104 can provide control signals 112 to boost converter 102. In one embodiment, the control signals 112 can be serial control bus signals. Boost converter 102 can also include an enable pin that can enable one or more features within boost converter 102. In one embodiment, the serial control bus can be used to control, at least in part, the current being directed to ground 150 from the display LED 108.

LED driver IC 104 can be configured to control display LED 108 brightness under at least two operational modes. In a first operational mode, a power on reset event can cause EEPROM (electrically erasable programmable read only memory) data to be loaded into hardware registers. Although EEPROM is used to exemplify non-volatile storage herein, other forms of non-volatile storage can be used such as masked ROM, NAND cells and battery backed RAM. The hardware registers can control LED driver IC 104 operation. In one embodiment, EEPROM data can be stored in EEPROM memory included in boost converter 102. After the power on reset event, the loaded hardware registers can be used as the default values in the LED driver IC 104. In this first operational mode, as soon as an enable signal 110 is asserted, LED driver IC 104 can become active and can control the output of display LED 108.

In a second operational mode, although EEPROM data can be loaded into hardware registers after a power on reset event, these values can be overridden prior to LED driver IC 104 becoming active through enable signal 110. For example, the power on reset event can cause initial values for the hardware registers to be loaded from EEPROM. Then, the initial values for hardware registers can be overridden through control signals 112, even when enable signal 110 is not asserted. In this second operational mode, a PWM signal from TCON 106 can affect a brightness of display LED 108. In one embodiment, a return current from display LED 108 is coupled to ground in accordance with the PWM signal from TCON 106.

Figure 2:
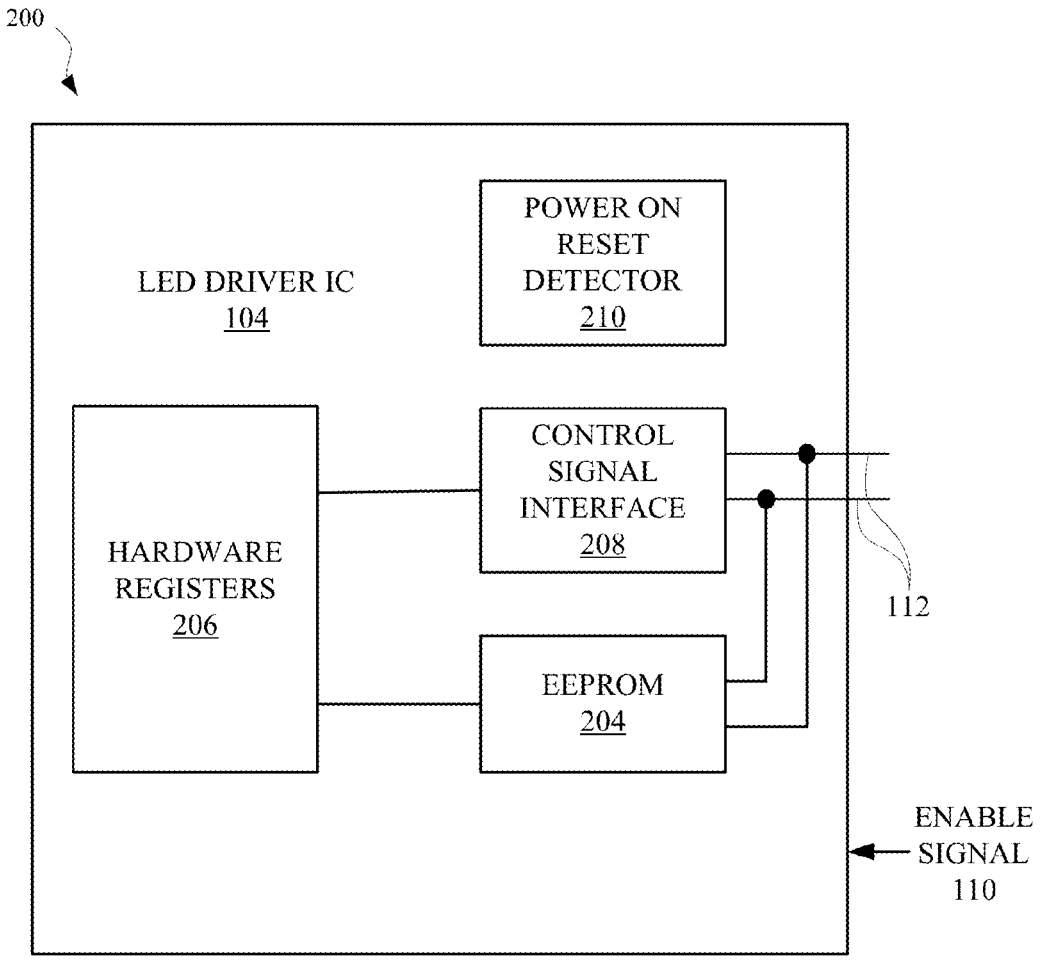
FIG. 2 is a block diagram of one embodiment of an LED driver IC.

FIG. 2 is a block diagram 200 of one embodiment of LED driver IC 104. In this embodiment EEPROM 204 can be included within LED driver IC 104. In other embodiments, EEPROM 204 can be separate from LED driver IC 104, but can be coupled through an address and data bus, for example. After a power on reset event is detected, data from EEPROM 204 can be transferred to hardware registers 206. Alternatively, a control signal interface 208 can be coupled to control signals 112 and a write or overwrite data in hardware registers 206. Power on reset detector 210 can detect when power applied to LED driver IC can transition from zero volts to an operating voltage. Enable signal 110 can enable operation of at least a portion of the LED driver IC 104.

Figure 3:
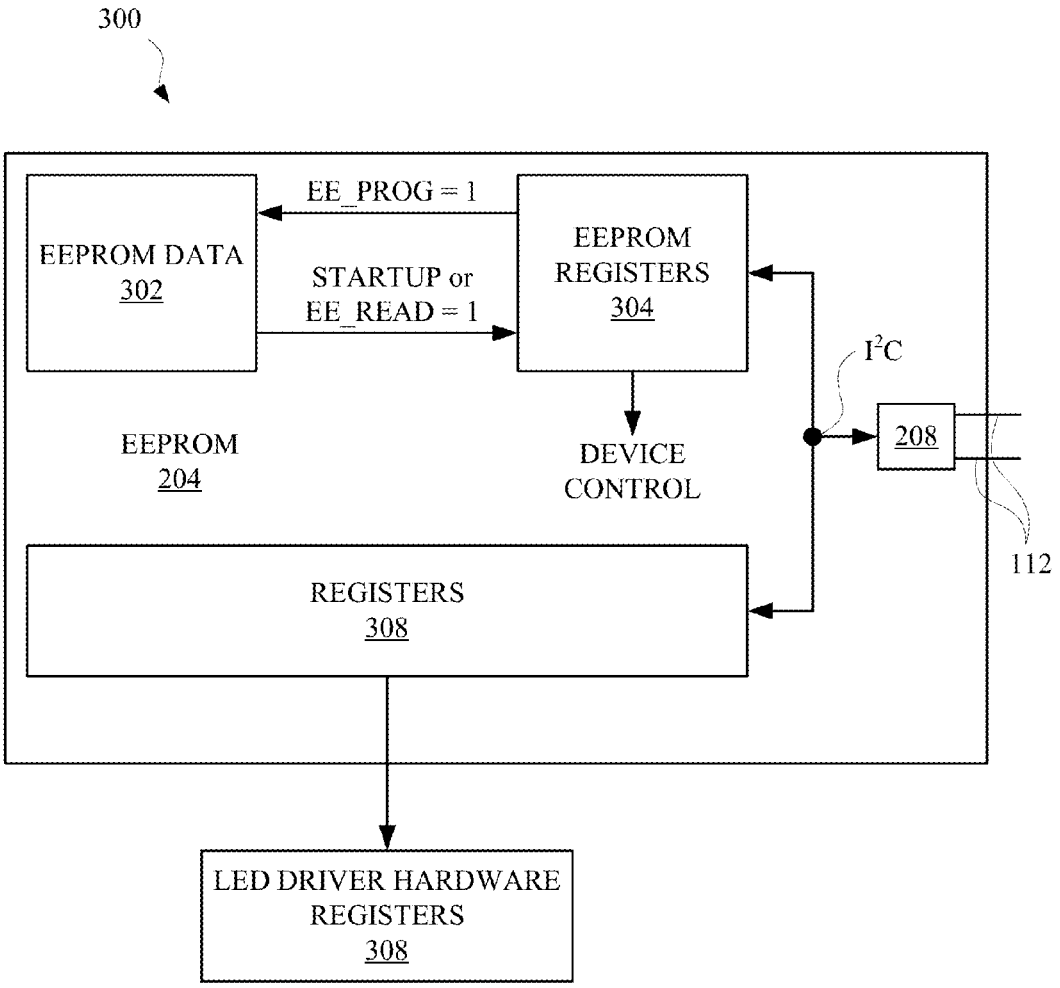
FIG. 3 is a block diagram illustrating the EEPROM and hardware registers shown in FIG. 2.

FIG. 3 is a block diagram 300 illustrating the EEPROM 204 and hardware registers 206 shown in FIG. 2 in accordance with one embodiment described in the specification. EEPROM 204 can include EEPROM registers 304 that provide access to EEPROM data 302. After a power on reset event, data from EEPROM data 302 can be retrieved by EEPROM registers 304 and transferred into registers 308. In some embodiments, EEPROM data can be transferred into LED driver IC 104 hardware registers 206. Control signals 112 can be received by control signal interface 208.

Figure 4:
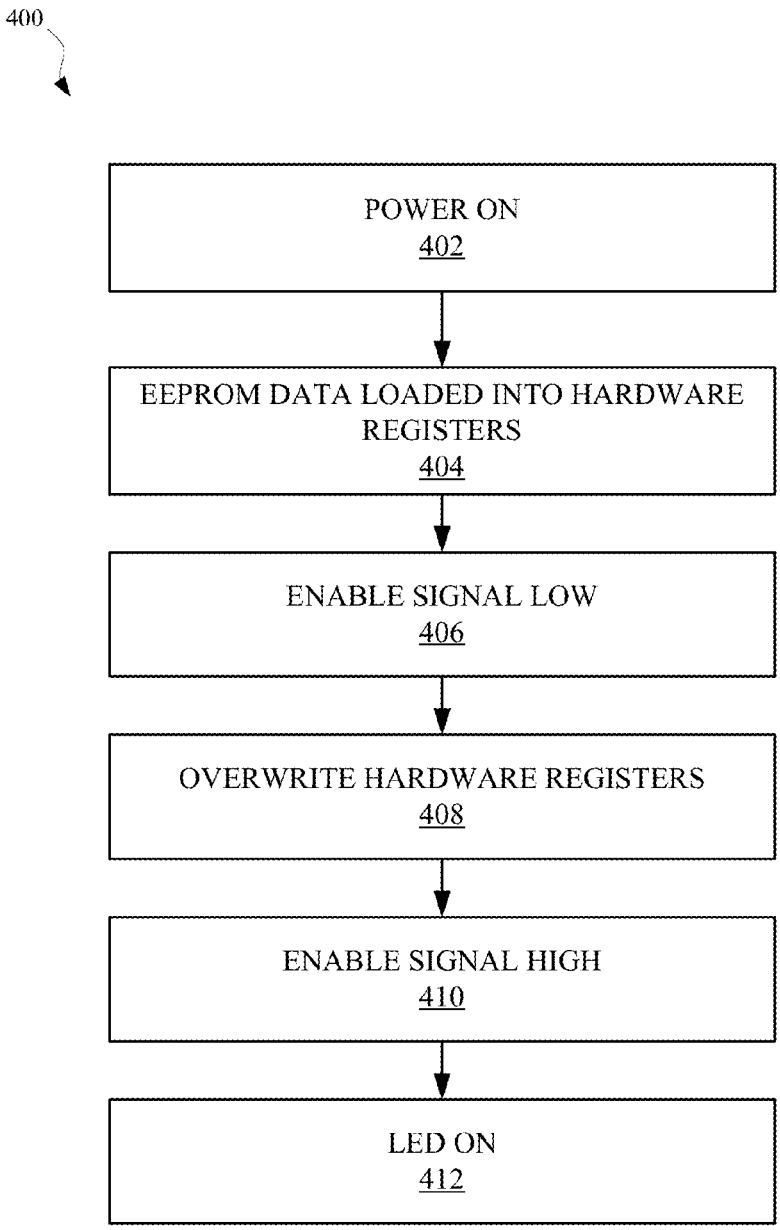
FIG. 4 is a flow chart of method steps for configuring LED driver IC when operating in the second operational mode.

FIG. 4 is a flow chart 400 of method steps for configuring LED driver IC 104 when operating in the second operational mode. The method can begin in step 402 when a power on reset event is detected. In one embodiment, a power on reset event can be when power is detected on the power supply pins of the LED driver IC 104. In step 404, data from EEPROM 204 can be transferred to hardware registers 206. In step 406 the enable signal 110 can be de-asserted. In step 408, the LED driver IC 104 can be configured with control signals 112 through control signal interface 208. In some embodiments, control signals 112 can be coupled to hardware registers 206 to enable configuration. In step 410 the enable signal 110 can be asserted. In step 412, the LED is turned on.

Figure 5:
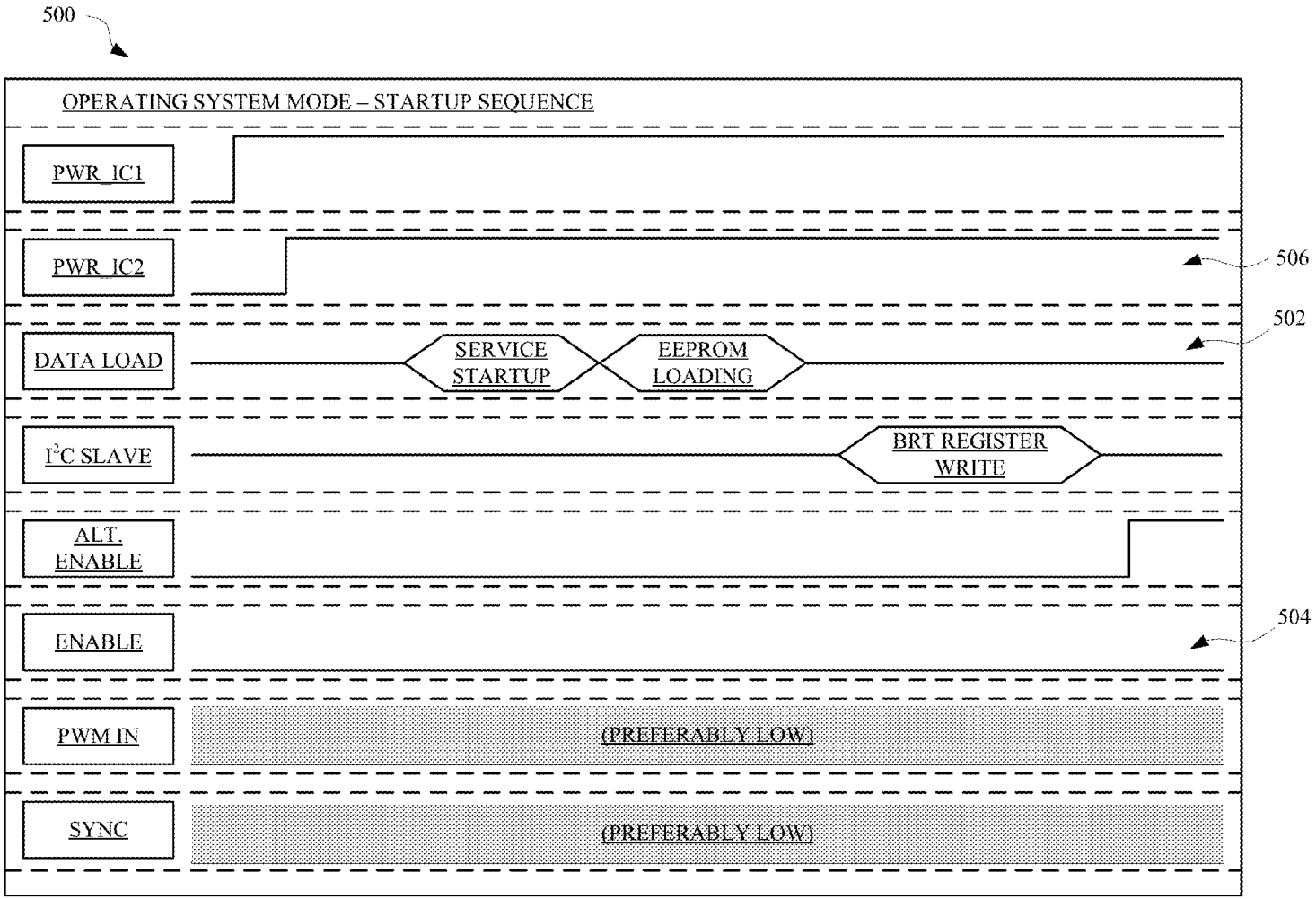
FIG. 5 is a timing diagram illustrating some of the signals related to a first operational mode for the LED driver IC.

FIG. 5 is a timing diagram 500 illustrating some of the signals related to a first operational mode for the LED driver IC 104. After a power on reset event, data from EEPROM 204 is loaded into hardware registers 206. The power on reset event can occur after power is applied to the LED drive IC 104 as shown by signal 506. Data loading from EEPROM 204 to hardware registers 206 is shown with signal 502. In this operational mode, display LED 108 is maintained in the off state until the enable signal 110 is asserted. Signal 504 illustrates the enable signal 110. Since, in this graph, the signal is always un-asserted, the display LED 108 is off.

Figure 6:
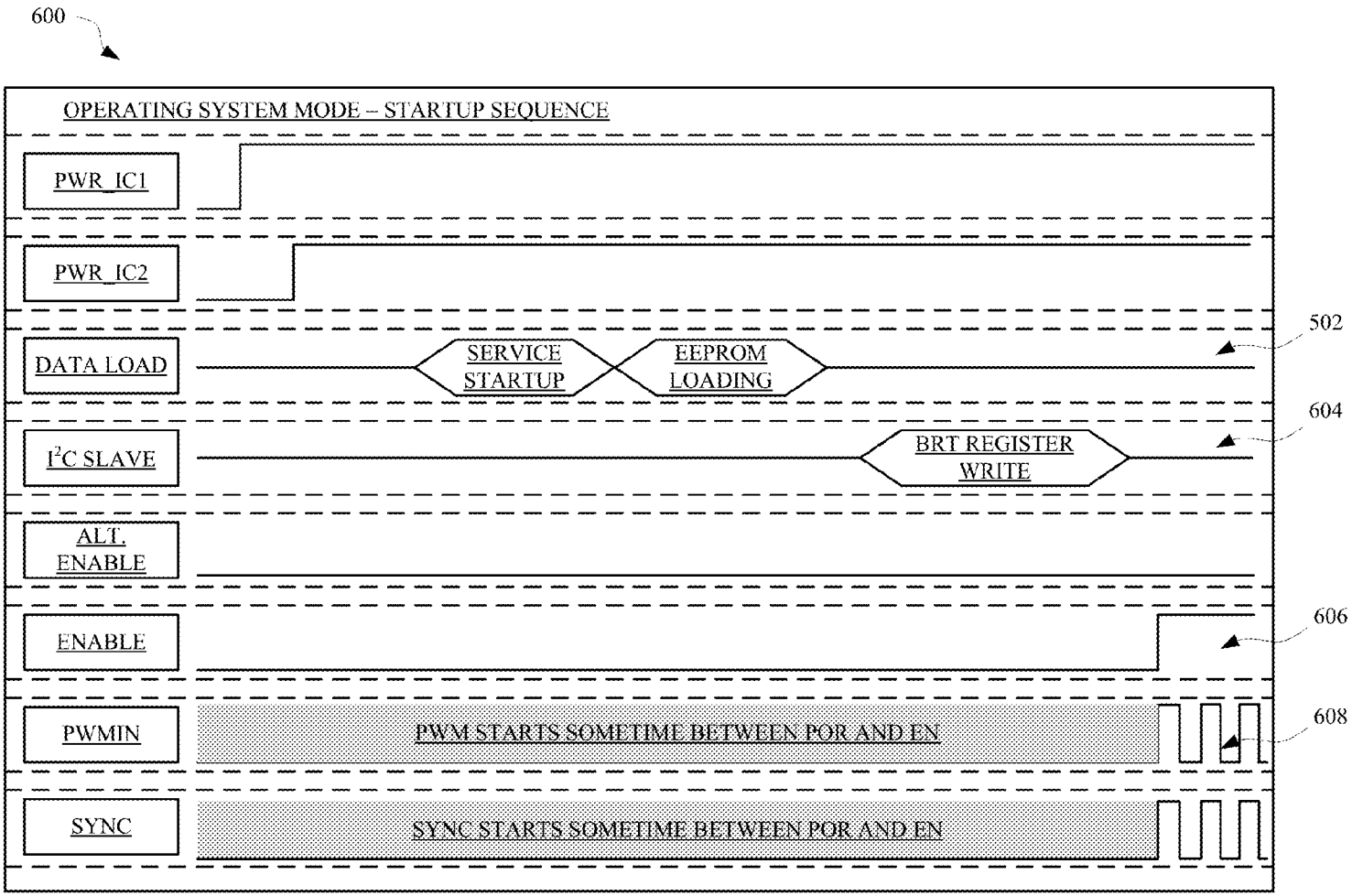
FIG. 6 is a timing diagram illustrating some of the signals related to a second operational mode for the LED driver IC.

FIG. 6 is a timing diagram 600 illustrating some of the signals related to a second operational mode for the LED driver IC. In this mode, after a power on reset event, data from EEPROM 204 is again loaded into hardware registers 206. The power on reset event can occur after power is applied to the LED drive IC 104 as shown by signal 506. Data loading from EEPROM 204 to hardware registers 206 is shown with signal 502. Control signals 112 can be used to overwrite the hardware registers 206, even before the enable signal 110 is asserted. Signal 604 illustrates timing of control signals 112 that can be used to overwrite hardware registers 206. Signal 606 illustrates the enable signal 110. Note that the enable signal is not asserted when control signals 112 are active. When enable signal 110 becomes asserted, the associated LED display can be enabled as well. In one embodiment a pulse width modulation (PWM) signal 608 is active and can be used to control display LED 108 brightness.

Figure 7:
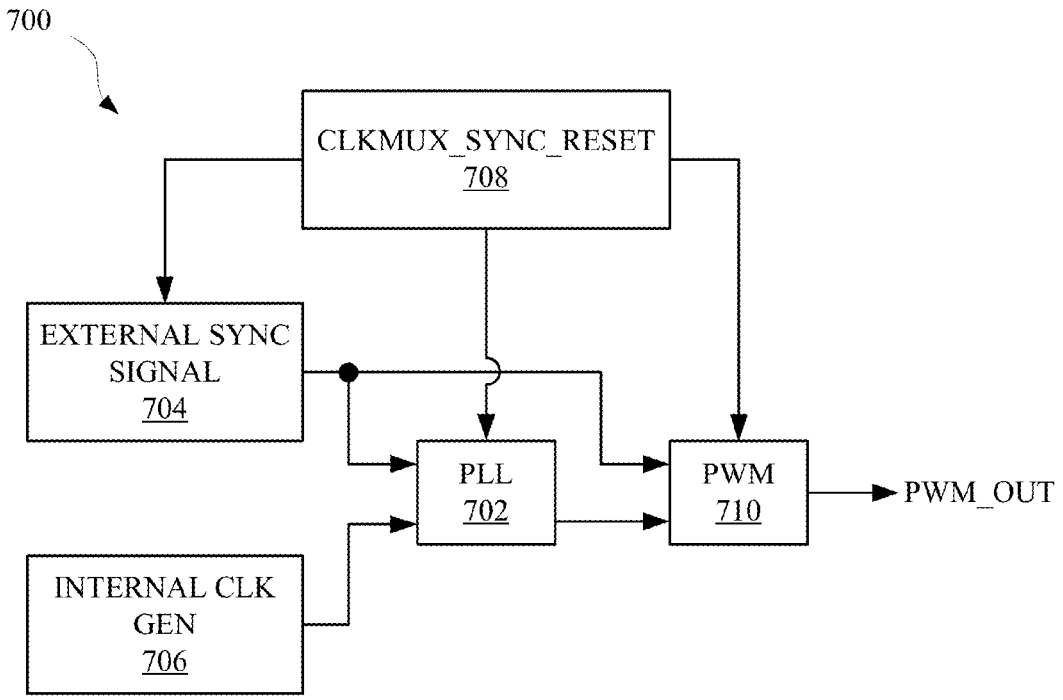
FIG. 7 is a block diagram of PWM generation circuit, in accordance with one embodiment of the specification.

Special signal handling of some clock or timing signals may be required when operation of LED driver IC 104 transitions from the first operational mode to the second operational mode or from the second operational mode to the first operational mode. In one embodiment a special reset signal can be used to reset at least one portion of a phased locked loop (PLL) system. FIG. 7 is a block diagram of PWM generation circuit 700, in accordance with one embodiment described in the specification. The PWM generation circuit can include a PLL 702, a PWM module 710, internal clock generator 706 and external sync signal module 704.

PWM module 710 can be used to control current sink circuits of the display LED 108. PWM module 710 can select either a signal from the external sync signal module 704 or a signal from the PLL 702 to base the output of the PWM module 710. In the first operational mode, the PLL 702 can phase lock the output of the external sync signal module 704 to the output of the internal clock generator 706. In one embodiment, the internal clock generator 706 can be based on an oscillator, such as a crystal oscillator. The phase locked output of the PLL 702 is coupled to the PWM module 710.

In the second operational mode, the PLL 702 is not used by the PWM module 710. In the second operational mode, a signal from the external sync signal module 704 is coupled to the PWM module 710. When transitioning from the second operational mode to the first operational mode, the sync path may require a reset signal, separate and independent from the power on reset signal. In one embodiment, the clkmux_sync_reset signal 708 can be applied to the external sync signal module 704, PLL 702 and PWM module 710 and reset internal registers and counters in these registers.

Figure 8:
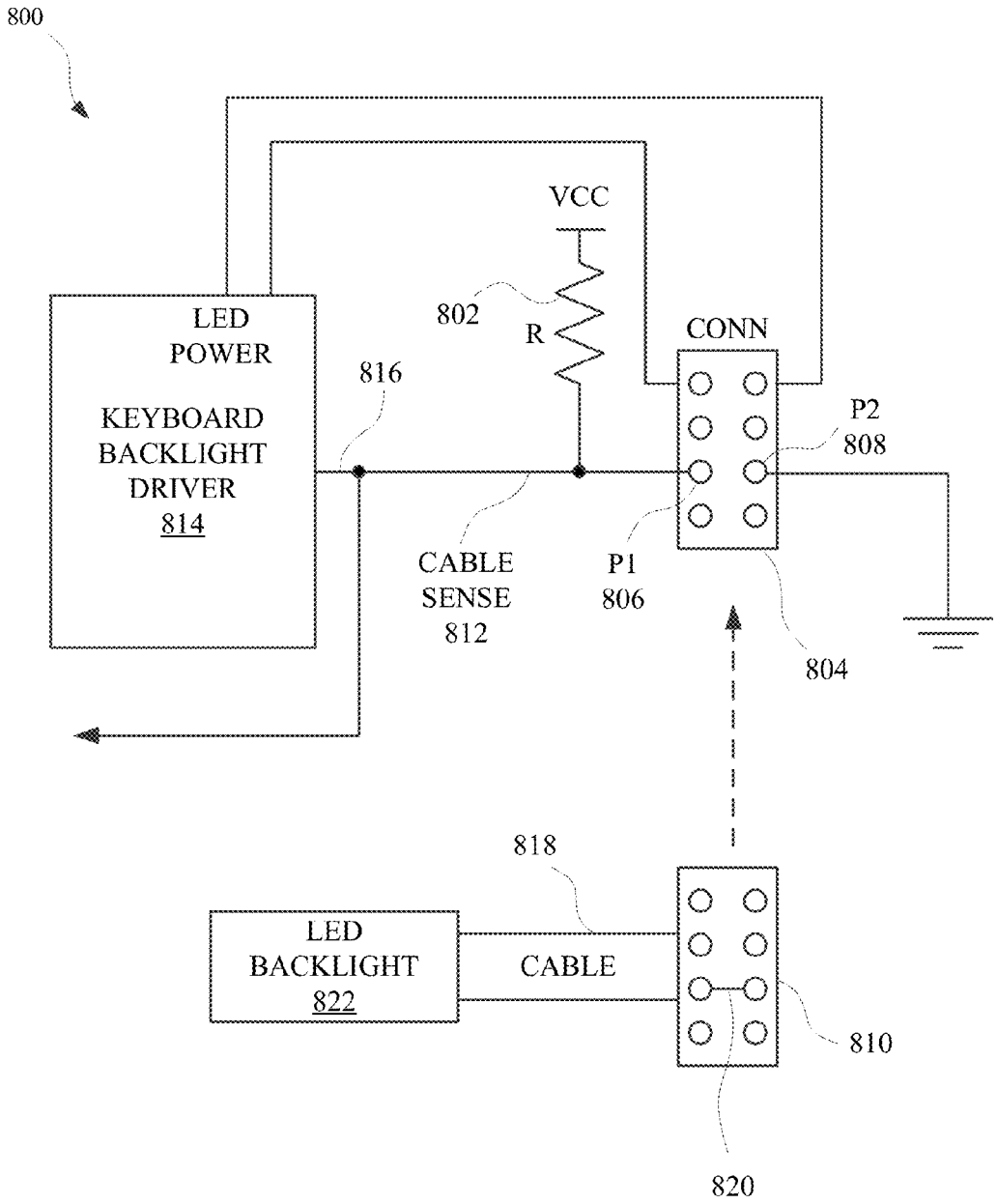
FIG. 8 is a simplified block diagram of a flex cable detection circuit in accordance with one embodiment of the specification.

FIG. 8 is a simplified block diagram of a flexible (flex) cable detection circuit 800 in accordance with one embodiment of the specification. By detecting the presence of a flex cable prior to operation, exposure to relatively high boost voltages can be controlled. Keyboard backlight driver 814 can provide a boost voltage necessary to control and light a LED keyboard backlight 822. Sometimes, the voltage necessary to light LED keyboard backlight 822 can be relatively higher than 5.0 or 3.3 volts. If the cable 818 to the LED keyboard backlight 822 is not connected to the keyboard backlight driver 814, these relatively higher voltages can be exposed. To detect the presence or absence of the cable 818, the keyboard backlight driver 814 can include a multimode pin 816. Multimode pin 816 can normally be used by a system micro-controller (SMC) to read a system parameter in the keyboard backlight driver 814. In an extra mode, the multimode pin 816 can be tri-stated and change from an output to an input. The multimode pin 816 can be used to detect the presence of the cable 818, and therefore control the enabling of power to the LED keyboard backlight 822.

Power for the LED keyboard backlight 822 is routed from the keyboard backlight driver 814 to a connector 804. A mating connector 810 can be coupled to connector 804 and can couple the power through cable 818 to LED keyboard backlight 822. At the same time, a shorting connection 820 can exist in mating connector 810, cable 818 or even within LED keyboard backlight 822. Shorting connection 820 can be used to short a first pin 806 to a second pin 808 at connector 804. If mating connector 810 is not coupled to connector 804, then pull-up resistor 802 can pull multimode pin 816 to a logic high level. On the other hand, if mating connector 810 is coupled to connector 804 then shorting connection 820 can effectively short first pin 806 to second pin 808, and thereby bring multimode pin 816 to a logic low level.

Prior to enabling the power for the LED keyboard backlight 822, the keyboard backlight driver 814 can sense the logic level at the multimode pin 816. If the multimode pin 816 is at a logic high, then the cable 818 is not connected, and the power for the LED keyboard backlight 822 will not be enabled. On the other hand, if the multimode pin 816 is at a logic low, then the cable 818 is connected, and the power for the LED keyboard backlight 822 will be enabled.

Figure 9:
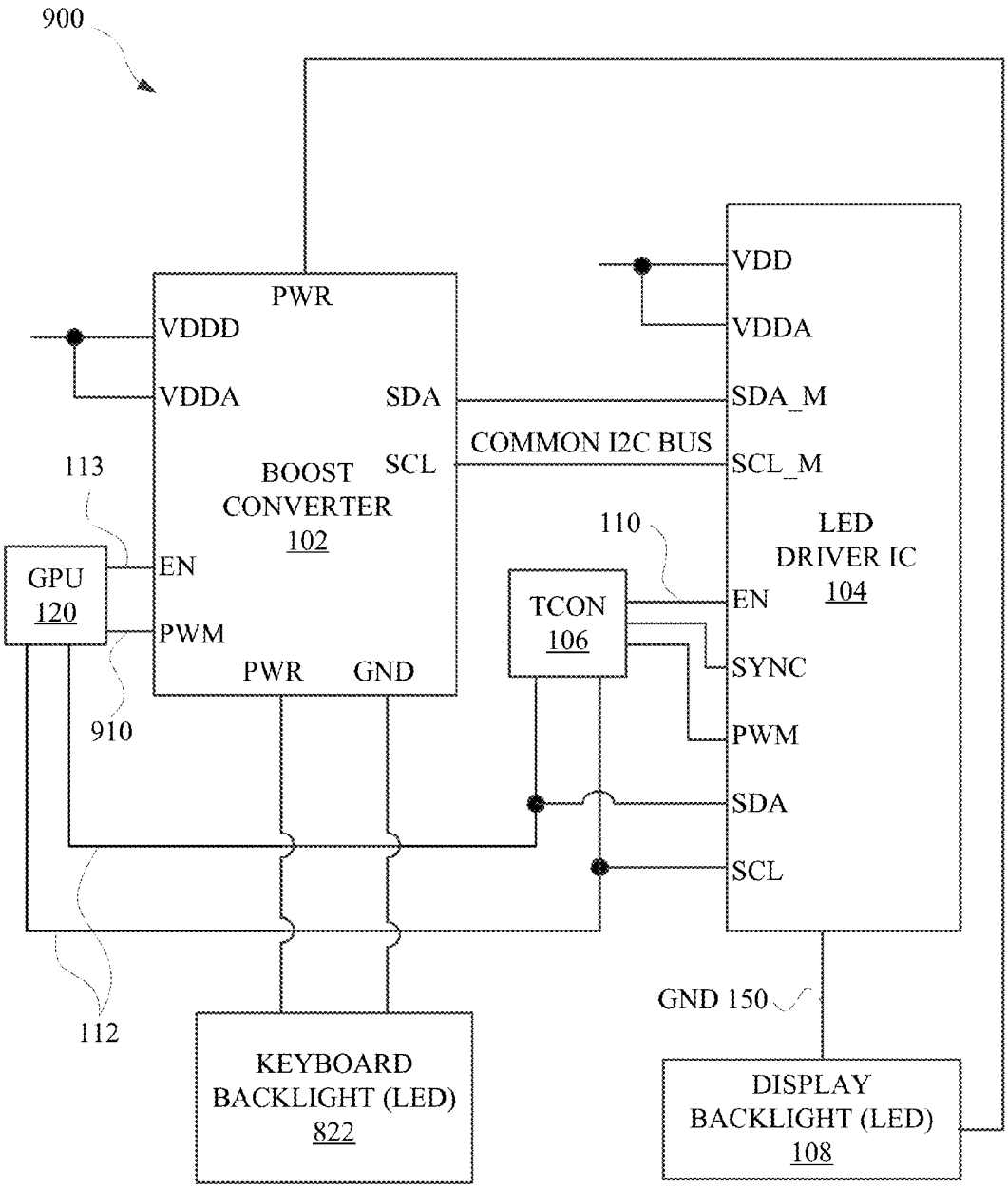
FIG. 9 is a block diagram of an LED light control system.

FIG. 9 is a block diagram of a LED light control system 900. In one embodiment, the control system 900 can independently control at least two LED systems. For example a first system can be a keyboard backlight and a second system can be a display backlight, where both backlights may be used in a portable computing device. The control system 900 can be built around two ICs: 1) boost converter 102 and 2) LED driver IC 104. The control system 900 can also include two LED arrays: LED keyboard backlight 822 and display LED 108. The LED keyboard backlight 822 can be coupled to the boost converter 102. That is, the boost converter 102 can provide boost voltage for both the LED keyboard backlight 822 display LED 108. Additionally, boost converter 102 can also sink a return current from LED keyboard backlight 822. Display LED 108 can be coupled to both boost converter 102 and LED driver IC 104. Boost converter 102 can provide boost voltage for display LED 108, while return current from display LED 108 can be sunk by LED driver IC 104 through ground 150.

Control system 900 can also include TCON 106 coupled to LED driver 104. TCON 106 can be configured to provide a PWM signal 910 to LED driver IC 104. LED driver IC 104 can sink current for display LED 108 in accordance with the PWM signal. TCON 106 can also control, at least in part, the output of LED driver IC 104 through manipulation of enable signal 110. In one embodiment, the output of LED driver IC 104 can be controlled through a combination of enable signal 110 and the PWM signal from TCON 106.

Control for both the boost converter 102 and LED driver IC 104 can be through GPU 120. As described in conjunction with FIG. 1, the GPU 120 can be replaced with any other technically feasible unit that can assert control signals 112. In one embodiment, GPU 120 can also include a dedicated enable signal 113 coupled to boost converter 102. GPU 120 can also provide a PWM signal 910 to boost converter 102 to guide the current sink for the keyboard backlight 822.

Independent control of the LED keyboard backlight 822 can be through dedicated enable signal 113. Independent control of LED driver IC 104 can be through control signals 112. In one embodiment, control signals 112 can be coupled to TCON 106 and LED driver IC 104. TCON 106 can, in turn, control enable signal 110 which can be coupled to LED driver IC 104.

Figure 10:
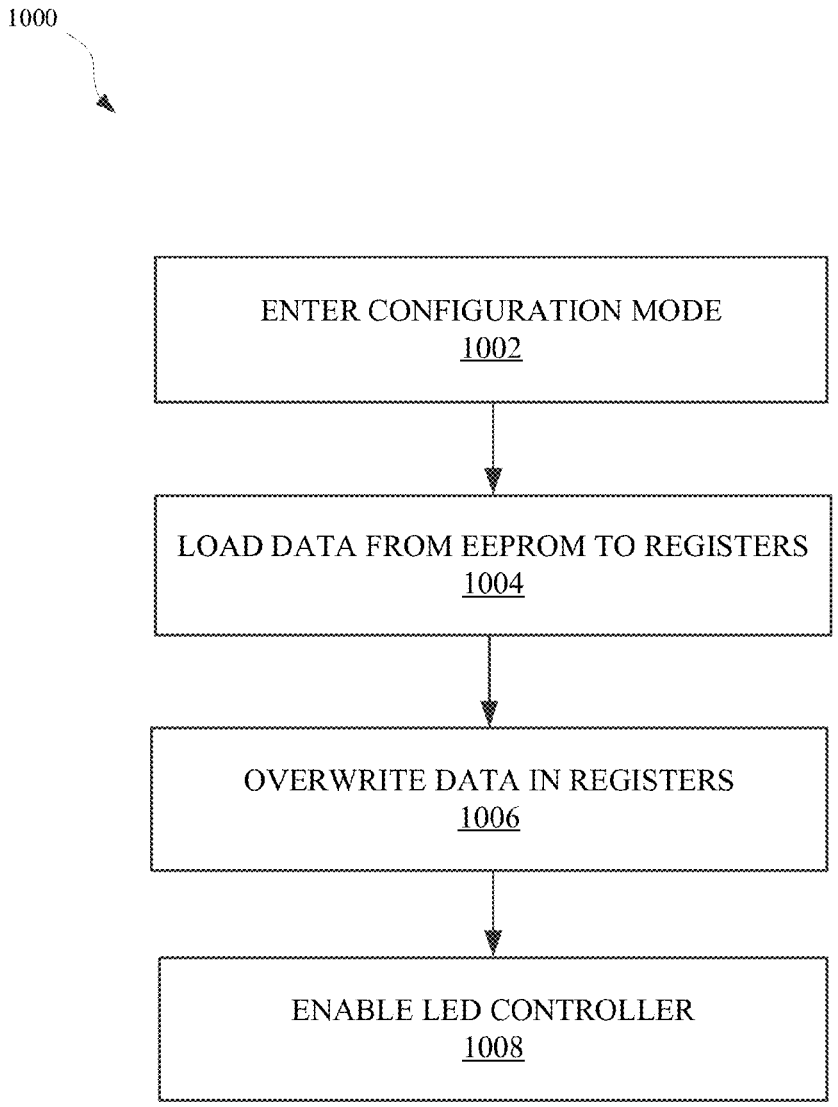
FIG. 10 is a flow chart of method steps for configuring a LED controller for use in a computing device.

FIG. 10 is a flow chart of method steps 1000 for configuring a LED controller for use in a computing device. The method can begin in step 1002 when a power on reset event is detected. In one embodiment, a power on reset event is detected when power supplied to the LED controller transitions from zero volts to an operating voltage. In step 1004, data from an EEPROM 204 can be loaded into hardware registers 206. In step 1006, data in hardware registers 206 can be over ridden with additional data. In one embodiment, the additional data can be written through a control signal interface 208. In step 1008, the LED controller output can be enabled thereby lighting a LED or LED array.

Figure 11:
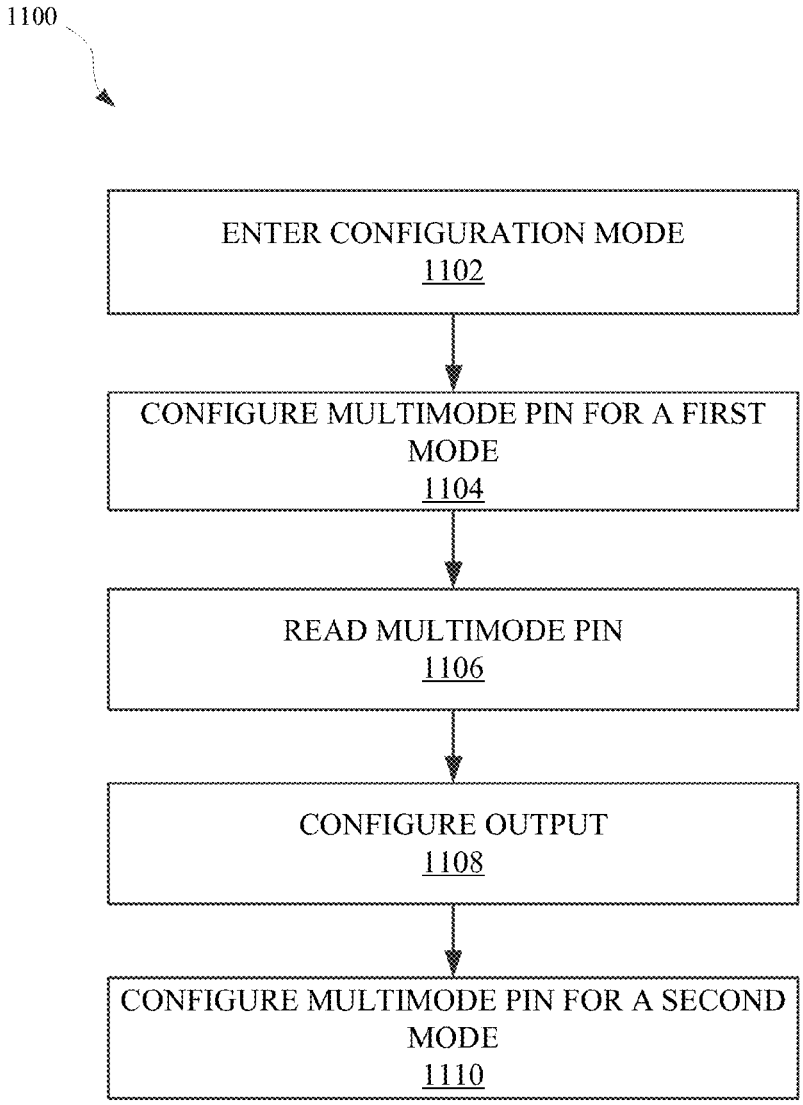
FIG. 11 is a flow chart of method steps for controlling the output state of a LED driver in a computing device.

FIG. 11 is a flow chart of method steps 1100 for controlling the output state of a LED driver in a computing device. The method can begin in step 1102 when the LED driver enters a configuration mode. In one embodiment, the configuration mode can be entered after detecting a power on reset event as described above. In step 1104, a multimode pin can be configured to operate in a first mode. In one embodiment, the multimode pin can be configured to operate as an input pin. In step 1106, the logic state of the multimode pin can be determined. For example, the multimode pin can be set to a logical '0' or a logical '1'. In step 1108, the output of the LED driver can be determined by the logic state of the multimode pin. In step 1110, the multimode pin can be configured to operate in a second mode and the method ends. For example, the multimode pin can be configured to operate as an output pin.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for configuring a light emitting diode (LED) controller for use in a computing device, the method comprising:

detecting a power on reset event when a supply power for the LED controller transitions from zero volts to an operating voltage;

prior to enabling LED operation, copying a first set of data from a memory located within the LED controller to LED operational control registers in response to detecting the power on reset event, wherein the first set of data is used to configure the LED controller for a first operational mode;

replacing data in LED operational control registers with a second set of data when operating a second operational mode; and enabling LED operation.

2. The method of claim 1, wherein the second set of data is received through a control signal interface.

3. The method of claim 1, wherein the enabling the LED operation is without flickering related to the replacing data in LED operational control registers.

4. The method of claim 1, wherein the first operational mode supports a first operating system running on the computing device.

5. The method of claim 1, wherein the LED controller controls a brightness of an LED array.

6. The method of claim 5, wherein the brightness of the LED array is further controlled in accordance with a received pulse width modulation (PWM) signal.

7. The method of claim 1, wherein the second set of data is an initial controller configuration for the second operational mode.

8. A configurable light emitting diode (LED) controller for use in a computing device, the configurable LED controller comprising:

a power on reset detector configured to determine when power is first applied to the configurable LED controller;

a non-volatile memory configured to store initial LED controller settings;

one or more registers configured to receive initial LED controller settings from the non-volatile memory when the power on reset event is detected, wherein LED operation is in accordance with data written into the one or more registers; and a control signal interface configured to write data into the one or more registers prior to enabling LED output.

9. The configurable LED controller of claim 8, wherein the initial LED controller settings stored in the non-volatile memory are for operation in a first mode.

10. The configurable LED controller of claim 9, wherein the data written into the one or more registers prior to enabling the LED output is for operation in a second mode.

11. The configurable LED controller of claim 10, wherein the control signal interface is a serial bus interface.

12. The configurable LED controller of claim 10, wherein a brightness of an LED coupled to the configurable LED controller is controlled with an external input signal when operating in the second mode.

13. The configurable LED controller of claim 12, further comprising a timing controller configured to provide a pulse width modulated signal to the external input signal.

14. The configurable LED controller of claim 8, wherein the non-volatile memory is electrically erasable.

15. A system controlling an light emitting diode (LED) backlight for a computing device, the system comprising:

an LED array configured as a backlight for the computing device;

an LED controller comprising:

a power on reset detector configured to determine when power is first applied to the LED controller, a non-volatile memory including a first set of data for configuring the LED controller in a first operational mode, hardware registers configured to receive the first set of data from the non-volatile memory when the power on reset event is detected, and wherein the LED array is controlled in accordance with data written into the hardware registers, and a control signal interface configured to over write data in hardware registers with a second set of data for configuring the LED controller to operate in a second operational mode; and a timing controller configured to produce a pulse width modulated (PWM) signal for controlling LED brightness when operating in the second operational mode.

16. The system of claim 15, wherein the control signal interface is a serial bus interface.

17. The system of claim 15, wherein the non-volatile memory is electrically erasable programmable read only memory.

18. The system of claim 15, wherein the timing controller provides control signals to the control signal interface.

19. The system of claim 18, wherein the control signal interface is a serial bus interface.

20. The system of claim 18, wherein the timing controller includes a phase lock loop.

* * * * *

UNITED STATES PATENT AND TRADEMARK OFFICE

CERTIFICATE OF CORRECTION

PATENT NO. : 8,933,643 B2
APPLICATION NO. : 13/659888
DATED : January 13, 2015
INVENTOR(S) : Alejandro Lara Ascorra et al.

It is certified that error appears in the above-identified patent and that said Letters Patent is hereby corrected as shown below:

In the Claims

Column 8, line 46 (Claim 15, line 1): “an light” should read -- a light --.

Signed and Sealed this
Fourteenth Day of July, 2015

Michelle K. Lee

Michelle K. Lee
*Director of the United States Patent and Trademark Office*